US005322755A

United States Patent [19]

Allen et al.

[11] Patent Number: 5,322,755

[45] Date of Patent: Jun. 21, 1994

[54] IMAGING MEMBERS WITH MIXED BINDERS

[75] Inventors: Charles G. Allen; Ah-Mee Hor, both of Mississauga, Canada

[73] Assignee: Xerox Corporation, Stamford, Conn.

[21] Appl. No.: 8,587

[22] Filed: Jan. 25, 1993

[51] Int. Cl.[5] ..... G03G 5/07

[52] U.S. Cl. ..... 430/96; 430/78; 430/59

[58] Field of Search ..... 430/96, 58, 59, 78

[56] References Cited

U.S. PATENT DOCUMENTS

| | | | |
|---|---|---|---|
| 3,121,006 | 2/1964 | Middleton et al. | 96/1 |
| 3,268,332 | 8/1966 | Caruso et al. | 430/96 |
| 4,265,990 | 5/1981 | Stolka et al. | 430/59 |
| 4,514,482 | 4/1985 | Loutfy et al. | 430/78 |
| 4,587,189 | 5/1986 | Hor et al. | 430/59 |
| 5,141,832 | 8/1992 | Takegawa et al. | 430/96 |

*Primary Examiner*—John Goodrow

*Attorney, Agent, or Firm*—E. O. Palazzo

[57] ABSTRACT

A layered photoconductive imaging member comprised of a supporting substrate, a photogenerator layer comprised of perylene photoconductive pigments dispersed in a resin binder mixture comprised of at least two polymers, and a charge transport layer.

24 Claims, No Drawings

IMAGING MEMBERS WITH MIXED BINDERS

BACKGROUND OF THE INVENTION

This invention is generally directed to imaging members and their utilization in, for example, electrophotography, and more specifically, to photogenerating layers comprised of photogenerating pigments dispersed in a mixture of polymeric binders to thereby enable, for example, improved photosensitivity thereof and other advantages as illustrated herein. The resulting layered imaging members possess a number of advantages, such as high photoconductivity, low dark decay and excellent stability over extended xerographic cycling, for example from about 1 percent to about 20 percent cycle down after 50,000 imaging cycles, flat spectral response at 400 to 900 nanometers in embodiments, and wherein, for example, the imaging members with photogenerating pigments like benzimidazole perylene have improved photosensitivity of $E_{\frac{1}{2}}$ of 3 ergs/cm$^2$ as compared to an $E_{\frac{1}{2}}$ of greater than 4 ergs/cm$^2$ for similar imaging members with a single binder for the photogenerating pigments.

Generally, layered photoresponsive imaging members are described in a number of U.S. patents, such as U.S. Pat. No. 4,265,900, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, oxymetallo phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating polymeric binder. The binder materials disclosed in the '006 patent comprise a material which is incapable of transporting for any significant distance injected charge carriers generated by the photoconductive particles. Polymeric binders for the photogenerating pigments include, for example, polycarbonates, polyvinylcarbazole, and the like. Also, illustrative examples of polymeric binder resinous materials that can be selected for the photogenerator pigment include those polymers as disclosed in U.S. Pat. No. 3,121,006, the disclosure of which is totally incorporated herein by reference.

In a copending application U.S. Ser. No. 537,714, the disclosure of which is totally incorporated herein by reference, there are illustrated photoresponsive imaging members with photogenerating oxytitanium phthalocyanine layers prepared by vacuum deposition dispersed in for example certain single resin binders like polycarbonates. It is indicated in this copending application that the imaging members comprised of the vacuum deposited oxytitanium phthalocyanines and aryl amine hole transporting compounds exhibit superior xerographic performance, since low dark decay characteristics result and higher photosensitivity is observed, particularly in comparison to several prior art imaging members prepared by solution coating or spray coating, reference, for example, U.S. Pat. No. 4,429,029.

In U.S. Pat. No. 5,206,359 there are disclosed imaging members with titanyl phthalocyanine photogenerating pigments dispersed in, for example, certain single resin binders, and wherein the phthalocyanine is prepared by the treatment of Type X oxytitanium phthalocyanine with a halobenzene; and more specifically, the solubilization of a Type I oxytitanium phthalocyanine, which can be obtained by the reaction of 1,3-diiminoisoindoline and titanium tetrabutoxide in the presence of a solvent, such as chloronaphthalene, reference U.S. Pat. No. 5,189,156, the disclosure of which is totally incorporated herein by reference, in a mixture of trifluoroacetic acid and methylene chloride, precipitation of the desired Type X oxytitanium phthalocyanine, separation by, for example, filtration, and thereafter subjecting the product to washing with fluorobenzene.

Perylene pigments, particularly the derivatives thereof prepared from perylene-3,4,9,10-tetracarboxylic acids or anhydrides, are useful photogenerating materials in layered imaging members for electrophotographic applications. For example, U.S. Pat. No. 4,587,189, the disclosure of which is totally incorporated herein by reference, illustrates imaging members containing a benzimidazole perylene layer prepared by vacuum evaporation or dispersion in a single polymeric binder. Other photogenerating pigments, such as azos, phthalocyanines, polycyclic quinones, squaraines, and the like, have been used in imaging members fabricated by vacuum evaporation, binder solution coatings or binderless pigment dispersions.

Also of interest is U.S. Pat. No. 4,514,482, the disclosure of which is totally incorporated herein by reference, directed to perylene photoconductive devices.

Improvement in the photosensitivity of photoconducting imaging members would have several advantages in the operation of electrophotography printing processes, for example the printing speed can be improved resulting in higher productivity. The required power of illuminating sources such as lasers, light emitting diodes, liquid crystal imaging bars, electric lamps, used to create the latent images on the photoconducting imaging member can be significantly reduced leading to cost savings in the hardware and operation aspects. Thus, the efficiency of imaging members can be increased when there is improvement in the photosensitivity thereof. Therefore, it is evident there is continued desire to improve the photoresponse properties of imaging members.

This invention in embodiments primarily relates to imaging members comprised of photogenerating pigments, like benzimidazole perylene prepared with selected mixtures of polymeric binders, which exhibit an unexpected improvement in photosensitivity as compared to, for example, when only a single binder was employed in preparing the imaging members. In addition, the mixed binders also possess additional advantages over the single binder system such as improvements in mechanical properties, superior pigment dispersion, and the like. The ability of maintaining mechanical integrity in layered imaging members is important as the delamination or large dimensional distortion of its various layers would be lead to severe degradation of image quality or complete operational failure. The pigment dispersion quality of the imaging members can have a strong impact on its printing quality such as graininess, resolution, uniformity of solid areas and the like, advantages achievable with the present invention in embodiments.

It is an objective of this invention to provide significant improvements in photosensitivity and other properties such as mechanical, and printing quality of the imaging members formed by using a mixture of binders instead of a single binder in dispersing the photogenerating pigments, and processes thereof.

SUMMARY OF THE INVENTION

It is an object of the present invention to provide imaging members with many of the advantages illustrated herein.

Another object of the present invention is to provide in embodiments imaging members with improved electrical characteristics and improved photosensitivity by selecting a polymeric binder mixture for the photogenerating pigments.

Also, another object of the present invention is to provide imaging members with improved electrical characteristics and improved photosensitivity by selecting a polymeric binder mixture of polyvinylcarbazole and polycarbonate for the photogenerating pigments comprised of benzimidazole perylenes, especially a mixture of the cis and trans isomers thereof.

It is yet another object of the present invention to provide processes for improving the characteristics of imaging members by utilizing for the photogenerating pigments a polymeric binder mixture comprised of at least two different polymers.

In embodiments, the present invention relates to layered photoconductive imaging members. More specifically, in embodiments of the present invention there are provided layered photoconductive imaging members comprised of a supporting substrate, a photogenerating layer and a charge transport layer, and wherein the photogenerating layer pigments are dispersed in a polymeric binder mixture.

An important aspect of the present invention resides in the selection of a binder mixture of two or more polymers comprised of, for example, polyvinylcarbazole, polycarbonates, polyvinyl butyral, and polyesters. One of the polymers in the mixture is preferably polyvinylcarbazole.

The components for the binder mixture for the photogenerating pigment, or pigments are selected in a manner that enables the desired improvement in photosensitivity, mechanical strength and printing quality. For example, for benzimidazole perylene pigment, it is believed that the relative amounts, by weight percent, of polymers like polyvinylcarbazole to polymers like polycarbonate can be varied from 10:90 to 90:10, with a preferred range being 10:90 to 30:70 as the miscibility and compatibility of polymers are improved, thereby minimizing the risks of phase separation and resulting nonuniformity in pigment dispersion. The preferred range affords further improved photosensitivity in embodiments, improved mechanical strength and excellent pigment dispersion quality. As a result of using a mixture of binders instead of a single binder in dispersing the photogenerating pigment, an unexpected improvement in photosensitivity of the benzimidazole perylene imaging members was observed. Although not being desired to be limited by theory, the mixture of binders is believed to be capable of enhancing the photogeneration and charge transport processes in imaging members as compared to the single binder system.

For example, the mechanical properties such as adhesion of layered imaging members using a mixture of two polymeric binders for dispersing photogenerating pigment, or pigments can be significantly improved relative to the single binder system. For example, polyvinylcarbazole possesses a poor film forming property and the photogenerating layer containing pigment and polyvinylcarbazole alone can possess poor adhesion. Delamination and creeping may occur after extensive flexing as encountered in the imaging process. By mixing in a second binder polymer such as polycarbonate in the photogenerator layer, the adhesion of the layer is greatly increased as determined by measuring the peel strength of the imaging member using an Instron machine. It is, therefore, preferable for an effective mixture of binders to have the polymeric component of weaker adhesion, such as PVK (polyvinylcarbazole), present in the smaller proportion, such as from about 10 to about 30 percent weight, relative to the other stronger binder resin component, such as polycarbonate. Typically, the peel strength of a PVK photogenerating layer was measured to be about 5 dynes/centimeter whereas a photogenerating layer containing a mixture of 10:90 weight percent of polyvinylcarbazole:polycarbonate had an excellent improved peel strength value of 20 dynes/centimeter.

Furthermore, it is believed that the dispersion quality of the photogenerating pigment is more uniform when a mixture of binders is used. One binder such as polyvinylcarbazole can be more strongly adsorbed onto the perylene pigment. The polyvinylcarbazole coated perylene can then be more effectively dispersed in a polycarbonate matrix. Thus, the polyvinylcarbazole functions as a dispersing agent for the perylene pigment in the polycarbonate in embodiments. Lack of agglomeration of pigment particles in the mixture of binders indicates excellent uniformity in the pigment dispersion.

The layered photoresponsive imaging members can be comprised of a supporting substrate, a charge transport layer, especially an aryl amine hole transport layer, and situated therebetween a photogenerator layer as illustrated herein, including the perylenes of U.S. Pat. Nos. 4,514,482 and 4,587,189, the disclosures of which are totally incorporated herein by reference, and with a resin binder mixture. The photoresponsive imaging members of the present invention can be prepared by a number of known methods, the process parameters and the order of coating of the layers being dependent on the member desired. The imaging members suitable for positive charging can be prepared by reversing the order of deposition of photogenerator and hole transport layers. The photogenerating and charge transport layers of the imaging members can be coated as solutions or dispersions onto selective substrates by the use of a spray coater, dip coater, extrusion coater, roller coater, wire-bar coater, slot coater, doctor blade coater, gravure coater, and the like, and dried at from 40° to about 200° C. for from 10 minutes to several hours under stationary conditions or in an air flow. The coating can be accomplished in such a manner that the final coating thickness is from 0.01 to about 30 microns after it has dried. The fabrication conditions for a given layer can be tailored to achieve optimum performance and cost in the final device.

Imaging members of the present invention are useful in various electrostatographic imaging and printing systems, particularly those conventionally known as xerographic processes. Specifically, the imaging members of the present invention are useful in xerographic imaging processes wherein the perylene pigments absorb light of a wavelength of from about 400 nanometers to about 900 nanometers. In these known processes, electrostatic latent images are initially formed on the imaging member followed by development, and thereafter transferring the image to a suitable substrate.

Moreover, the imaging members of the present invention can be selected for electronic printing processes with gallium arsenide light emitting diode (LED) arrays and diode lasers which typically function at wavelengths of from 660 to about 830 nanometers.

DESCRIPTION OF EMBODIMENTS

A negatively charged photoresponsive imaging member of the present invention is comprised of a supporting conducting substrate coated with a charge blocking layer comprised, for example, of a silane layer or a mixed silane/zirconium oxide layer, an optional solution coated adhesive layer thereover comprised, for example, of a polyester 49,000 available from Goodyear Chemical, a photogenerator layer thereover the adhesive layer and comprised of benzimidazole perylene dispersed in a resin binder mixture of polyvinyl carbazole and polycarbonate and a charge transport layer comprised of N,N'-diphenyl-N,N'-bis(3-methylphenyl)-1,1'-biphenyl-4,4'-diamine, dispersed in a polycarbonate resinous binder.

Substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR ® a commercially available polymer, MYLAR ® containing titanium, a layer of an organic or inorganic material having a semiconductive surface layer such as indium tin oxide or aluminum arranged thereon, or a conductive material inclusive of aluminum, chromium, nickel, brass or the like. The substrate may be flexible, seamless, or rigid and many have a number of many different configurations, such as for example a plate, a cylindrical drum, a scroll, an endless flexible belt and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON ®.

The thickness of the substrate layer depends on many factors, including economical considerations, thus this layer may be of substantial thickness, for example over 3,000 microns, or of minimum thickness providing there are no adverse effects on the system. In one embodiment, the thickness of this layer is from about 75 microns to about 300 microns.

With further regard to the imaging members, the photogenerator layer is comprised of a number of known photogenerating pigments such as perylenes, phthalocyanines, and the like. Generally, the thickness of the photogenerator layer depends on a number of factors, including the thicknesses of the other layers and the amount of photogenerator material contained in this layer. Accordingly, this layer can be of a thickness of from about 0.05 micron to about 10 microns when the photogenerator composition is present in an amount of from about 5 percent to about 100 percent by volume. In one embodiment, this layer is of a thickness of from about 0.1 micron to about 1 micron when the photogenerator composition is present in this layer in an amount of 10 to 90 percent by volume. The maximum thickness of this layer in an embodiment is dependent primarily upon factors, such as photosensitivity, electrical properties and mechanical considerations. The charge generator layer can be obtained by dispersion coating of the photogenerating pigment and resin binder mixture with a suitable known solvent. The dispersion can be prepared by mixing and/or milling the photogenerating pigment and resin binder mixture in equipment such as paint shakers, ball mills, sand mills and attritors. Common grinding media such as glass beads, steel balls or ceramic beads may be used in this equipment.

A binder resin mixture as illustrated herein selected and one of the resins may be selected from number of polymers, such as polyvinyl butyral, polyvinylcarbazole, polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like in various effective amounts. Mixture examples containing two binders are polyvinylcarbazole:polycarbonate, polyvinylcarbazole:polyvinylbutyral, and polyvinylcarbazole:polyester. The weight percent of polyvinylcarbazole in the two-binder mixture is from 5 to 95, and preferably from about 5 to 30 weight percent. Examples of mixtures containing three binders are polyvinylcarbazole:polyester:polycarbonate, polyvinylcarbazole:polyvinylbutyral:polycarbonate, and the like. The weight percent of polyvinylcarbazole in the three-binder mixture is preferably from about 5 to 30 percent and the total weight percent of the other two polymers is from about 95 to about 70 percent.

Solvents in effective amounts which depend on the binder resins selected, such as typically 10 to 100 parts of solvent for 1 part of polymer, are selected to dissolve the binders. In embodiments of the present invention, it is desirable to select solvents that do not effect the other coated layers of the device. Examples of solvents useful for the coating to form the photogenerator layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, methoxyethyl acetate, and the like. The coating of the aforementioned dispersion in embodiments of the present invention can be accomplished with spray, dip or wire bar methods such that the final dry thickness of the photogenerating layer is from about 0.01 to about 30 microns and preferably from about 0.1 to about 15 microns after being dried at 40° to 150° C. for 5 to 90 minutes.

As a blocking layer present on the substrate, there can be selected various known silanes or silane/zirconium oxide mixtures, polyamides or polyurethanes. This layer is of a thickness of from about 0.01 micron to 10 microns, preferably from 0.02 micron to 0.20 micron.

As optional adhesives, there can be selected various known substances inclusive of polyesters, polyamides, poly(vinyl butyral), poly(vinyl alcohol), polyurethane and polyacrylonitrile. This layer is of a thickness of from about 0.05 micron to about 1 micron. Optionally, this layer may contain conductive and nonconductive particles, such as zinc oxide, titanium dioxide, silicon nitride, carbon black, and the like, to provide, for example, in embodiments of the present invention desirable electrical and optical properties.

Aryl amines selected for the charge transporting layer which is generally of a thickness of from about 5 microns to about 75 microns, and preferably of a thickness of from about 10 microns to about 40 microns, include molecules of the following formula:

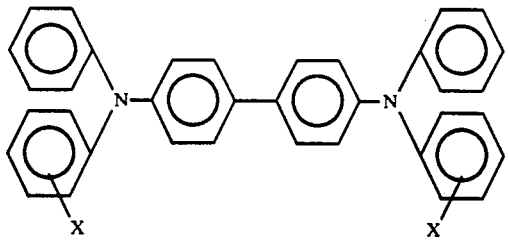

dispersed in a highly insulating and transparent organic resinous binder wherein X is an alkyl group or a halogen, especially those substituents selected from the group consisting of (ortho) $CH_3$, (para) $CH_3$, (ortho) Cl, (meta) Cl, and (para) Cl.

Examples of specific aryl amines are N,N'-diphenyl-N,N'-bis(alkylphenyl)-1,1-biphenyl-4,4'-diamine wherein alkyl is selected from the group consisting of methyl, such as 2-methyl, 3-methyl and 4-methyl, ethyl, propyl, butyl, hexyl, and the like. With chloro substitution, the amine is N,N'-diphenyl-N,N'-bis(halophenyl)-1,1'-biphenyl-4,4'-diamine wherein halo is 2-chloro, 3-chloro or 4-chloro. Other known hole transporting compounds can be selected.

Examples of the highly insulating and transparent resinous material or inactive binder resinous material for the transport layers include materials such as those described in U.S. Pat. No. 3,121,006, the disclosure of which is totally incorporated herein by reference. Specific examples of organic resinous materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000, with a molecular weight of from about 50,000 to about 100,000 being particularly preferred. Generally, the resinous binder contains from about 10 to about 75 percent by weight of the active material corresponding to the foregoing formula, and preferably from about 35 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

Imaging members in which the photogenerator layer is coated by using a mixture of polymer binders can exhibit improved photosensitivity, thereby requiring significantly less expose energy in the imaging process. The power of illuminating sources, such as lasers, light emitting diodes, and electric lamps, used to create the latent images on the imaging members can be significantly reduced resulting in cost savings in the hardware and in the operation of the imaging process. The use of a mixture of polymer binders also affords in embodiments improved dispersion uniformity of photogenerating pigments in the photogenerator layer and thereby ensures excellent printing quality without observable defects such as dark spots, or uneven solid area. Furthermore, the adhesion properties of photogenerator layers containing a mixture of binders is enhanced such that delamination of layered imaging members is minimized, or avoided.

The invention will now be described in detail with reference to specific preferred embodiments thereof, it being understood that these Examples are intended to be illustrative only. The invention is not intended to be limited to the materials, conditions, or process parameters recited herein.

EXAMPLE I

Preparation of Benzimidazole Perylene Sublimate Materials:

78.7 Parts of 1-chloronaphthalene, 4.3 parts of perylene-3,4:9,10-tetracarboxylic dianhydride and 11.9 parts of o-phenylenediamine were charged in a stainless steel reactor equipped with a pitched blade turbine agitator, a circulation jacket connected to an oil supply system, a temperature measuring element and a distillation line with a condenser. After the aforementioned raw materials were charged and the agitator speed adjusted to 200 rpm, the reactor was purged with nitrogen gas, and the reactor contents were heated by raising the temperature of the jacket in about one hour to the desired reaction temperature of 240° to 245° C. The reaction was continued for an additional 6 hours at this temperature. The reactor was then cooled by cooling the jacket oil with water to about 90° C. and the reactor contents were then transferred to a Nutsche vacuum filter equipped with an agitator. The filtrate was drained by applying vacuum to the filter. The crude, wet pigment cake was reslurry washed twice using 80 parts of warm dimethylformamide, with the wash filtrate drained each time by vacuum filtration. The cake was subsequently reslurry washed nine times with alkaline methanol at room temperature to, for example, remove acidic impurities. Each alkaline methanol wash was prepared by dissolving 0.33 part of sodium hydroxide in 66 parts of methanol. The pigment cake was then reslurry washed four times with methanol (66 parts of methanol used in each wash) and dried in a vacuum dryer at 65° C. and full vacuum for 16 hours. 5.89 Parts of crude benzimidazole perylene powder were obtained.

The sublimation of the above benzimidazole perylene was accomplished in a vacuum chamber equipped with a stainless steel crucible, about 4 inches in diameter and 20 inches in length, placed below, about 4 inches, a stainless steel collector substrate sheet, about 24 inches long, about 36 inches wide, and about 1/32 inches thick. Crude benzimidazole perylene powder material was compressed into the cylindrical pellets (4 millimeters in height and 13 millimeters in diameter) by using a Stokes Tablet Press operated at a pressure reading of one ton. About 600 grams of crude perylene pellets was placed into the crucible. After evacuating the chamber to a pressure of about $10^{-4}$ to $10^{-5}$ Torr, an electric current of 400 to 500 amperes was supplied to the crucible, and the temperature of the crucible was raised to about 500° to about 530° C. Some of the crude material began to sublime into a vapor which then condensed to deposit onto a collector sheet of stainless steel positioned about 4 inches directly above the crucible. After maintaining the crucible at the 500° to 530° C. temperature for 10 minutes, the electric current was turned off. When the crucible had cooled down to below 200° C., air was admitted into the vacuum chamber to bring the pressure to atmospheric. The collector substrate was removed from the chamber and about 44 grams of a first fraction sublimate (Sample IA) was collected from the substrate by removal thereof with a scraper blade. A second clean collector comprised of a stainless steel sheet was installed and the chamber was evacuated as before. The crucible was then heated to about 540° C. for about 60 minutes and then further increased to 570° C. for another 130 minutes. After cooling, 408 grams of a second fraction sublimate (Sample IB) deposited onto the collector was obtained by removal thereof with a scraper blade. The yield of the second fraction was 68 percent based on the amount of the starting crude material initially placed in the crucible. The aforementioned fractions were each comprised of the cis isomer bisbenzimidazo(2,1-a:1',2'-b')anthra(2,1,9-def:6,5,10-d'e'f'-)diisoquinoline-6,11-dione and the trans isomer bisbenzimidazo(2,1-a:2', 1'-a')anthra(2,1,9-def:6,5,10-d'e'f'-)diisoquinoline-10,21-dione, 50 weight percent cis and 50 weight percent trans. For brevity, the perylene composition is usually designated as benzimidazole perylene.

EXAMPLE II

Three photoresponsive imaging members were fabricated using the benzimidazole perylene sublimate material (sample IB) of Example I. The imaging members were comprised of a titanium metallized MYLAR® substrate of 75 microns in thickness, sequentially overcoated with a thin photogenerator layer of the perylene sublimate, and an aryl amine charge transport layer. Three different polymer compositions were used in coating the photogenerator layers. For the first imaging member IIA, the polymer binder comprised of a 30:70 weight percent mixture of polyvinylcarbazole (PVK) and polycarbonate (PC) was used in making the photogenerator layer. For the second member IIB, the polymer was polyvinylcarbazole, and in the third member IIC, the polymer was polycarbonate. PVK was purchased from BASF and had a molecular weight of 600,000. Polycarbonate was purchased from Mitsubishi Gas Chemical and had a molecular weight of 26,000.

The imaging members were fabricated in accordance to the following procedure. The photogenerator layer was prepared by solution coating the perylene dispersion. The perylene dispersion was prepared as follows: 0.40 gram of perylene sublimate sample was mixed with 0.10 gram of the polymer in a 30 cc glass bottle containing 70 grams of ⅛ inch stainless steel balls and 12.2 grams of methylene chloride. The bottle was placed on a roller mill and the dispersion was milled for 5 days. The perylene dispersion was coated onto a titanium metallized MYLAR® using a film applicator of 1.5 mil gap. Thereafter, the photogenerator layer was dried in a forced air oven at 135° C. for 20 minutes and the measured thickness was 1 micron. The pigment loading in the photogenerator layer was 80 weight percent. The aryl amine transport layer was prepared as follows. A transport layer solution was made by mixing 8.3 grams of MAKROLON®, a polycarbonate resin, 4,4 grams of N,N'-diphenyl-N,N'-bis(3-methylphenyl)-(1,1'-biphenyl)-4,4'-diamine and 82.3 grams of methylene chloride. The solution was coated onto the above photogenerator layer using a film applicator of 10 mil gap. The resulting member was dried at 135° C. in a forced air oven for 20 minutes and the final dried thickness of the transport layer was 20 microns.

The xerographic electrical properties of each imaging member were then determined by electrostatically charging its surface with a corona discharging device until the surface potential, as measured by a capacitively coupled probe attached to an electrometer, attained an initial value $V_o$. After resting for 0.5 second in the dark, the charged member reached a surface potential of $V_{ddp}$, dark development potential, and was then exposed to light from a filtered xenon lamp. A reduction in the surface potential to $V_{bg}$, background potential, due to photodischarge effect was observed. The dark decay in volts/second was calculated as $(V_o-V_{ddp})/0.5$. The lower the dark decay value, the better is the ability of the member to retain its charge prior to exposure by light. The photosensitivity of the imaging member can be described in terms of $E_{\frac{1}{2}}$, amount of exposure energy in erg/cm$^2$ required to achieve 50 percent photodischarge from the dark development potential. The higher the photosensitivity, the smaller is the $E_{\frac{1}{2}}$ value. High photosensitivity (lower $E_{\frac{1}{2}}$ value), lower dark decay and high charging are desired for the improved performance of xerographic imaging members.

According to the procedure mentioned above, three types of imaging members were prepared and tested.

The following table summarizes the polymer compositions in the photogenerator layer and the xerographic electrical results. The imaging member IIA required substantially less (about 30 percent) expose energy to attain half-discharge than either of imaging members IIB and IIC. The mixture of polycarbonate and polyvinylcarbazole binders in the photogenerator layer had unexpectedly increased the photosensitivity of benzimidazole perylene as compared to the situation where a single polymer polyvinylcarbazole or polycarbonate was used in the preparation of the photogenerator layer.

| IMAGING MEMBER | POLYMER COMPOSITION IN PHOTOGENERATOR LAYER | DARK DECAY V/S | $E_{\frac{1}{2}}$ ERG/CM$^2$ |
|---|---|---|---|
| IIA | 30:70 weight % polyvinylcarbazole and polycarbonate | 20 | 2.7 |
| IIB | polyvinylcarbazole | 24 | 3.5 |
| IIC | polycarbonate | 19 | 3.7 |

EXAMPLE III

In accordance with the processes of Example II, a series of imaging members were fabricated using different compositions of polyvinylcarbazole (PVK) and polycarbonate (PC) in preparing photogenerator layers. The following table summarizes the polymer compositions and xerographic electrical results. Members III C, D, E, and F evidence improvement in photosensitivity with respect to III A or III G. The results indicate that the photosensitivity improvement can be obtained when the mixture of binders, such as polyvinylcarbazole and polycarbonate, was used in preparing the photogenerator layer as compared to the single binder. The preferred mixture composition was 10 to 70 weight percent of polyvinylcarbazole and 90 to 30 weight percent of the polycarbonate.

| IMAGING MEMBER | WEIGHT % OF PVK:PC IN PHOTOGENERATOR LAYER | DARK DECAY V/S | $E_{\frac{1}{2}}$ ERGS/CM$^2$ |
|---|---|---|---|
| IIIA | 100:0 | 24 | 3.5 |
| IIIB | 90:10 | 16 | 3.4 |
| IIIC | 70:30 | 21 | 3.0 |
| IIID | 50:50 | 22 | 3.0 |
| IIIE | 30:70 | 20 | 2.7 |
| IIIF | 10:90 | 18 | 2.8 |
| IIIG | 0:100 | 19 | 3.7 |

P/S improvement using PVK:PC(Z) not limited to a specific ratio. Either binder alone is evident.

EXAMPLE IV

Two imaging members IVA and IVB containing 60 weight percent of perylene pigment loading in the photogenerator layer were prepared in accordance with Example II, with the exception that 0.30 gram of benzimidazole perylene and 0.20 gram of polymer mixture were used. The composition of polymers used is as follows. For the first member IVA, the polymer was a mixture of 10:90 weight percent of polyvinylcarbazole (PVK) and polycarbonate (PC). For the second member IVB, only polyvinylcarbazole was used. The xerographic test results are shown below. At 60 weight percent pigment loading, device IVA containing a mixture of polyvinylcarbazole and polycarbonate in the photogenerator also exhibits significantly higher photosensitivity than device IVB. The former requires about 35 percent less exposure energy to achieve half-discharge potential than the latter.

| IMAGING MEMBER | POLYMER COMPOSITION IN PHOTOGENERATOR LAYER | DARK DECAY V/S | $E_{\frac{1}{2}}$ ERG/CM$^2$ |
|---|---|---|---|
| IVA | 10:90 weight % of PVK:PC | 21 | 3.5 |
| IVB | PVK | 14 | 5.4 |

Imaging member VA was prepared in accordance with Example II using the follow composition in preparing the photogenerator layer. 0.4 Gram of benzimidazole perylene, 10.1 grams of monochlorobenzene, 0.05 gram of PVK and 0.05 gram of polyvinylbutyral (BUTVAR B76 TM from Monsanto, molecular weight=50,000). Imaging member VB was prepared in a similar manner except that the binder polymer was 0.1 gram of PVK. The xerographic electrical test results are shown below. Member VA containing a mixture of binders, PVK and PVB, in the photogenerator layer required 26 percent less light energy to be photodischarged to the half of initial potential than member VB in which single binder was employed in the generator layer.

| IMAGING MEMBER | POLYMER COMPOSITION IN PHOTOGENERATOR LAYER | DARK DECAY V/S | $E_{\frac{1}{2}}$ ERG/CM$^2$ |
|---|---|---|---|
| VA | 50:50 weight % of PVK:PVB | 11 | 3.5 |

-continued

| IMAGING MEMBER | POLYMER COMPOSITION IN PHOTOGENERATOR LAYER | DARK DECAY V/S | $E_{\frac{1}{2}}$ ERG/CM$^2$ |
|---|---|---|---|
| VB | PVK | 16 | 4.8 |

Other modifications of the present invention may occur to those skilled in the art subsequent to a review of the present application. The aforementioned modifications, including equivalents thereof are intended to be included within the scope of the present invention.

What is claimed is:

1. A layered photoconductive imaging member consisting essentially of a supporting substrate, a photogenerator layer of perylene photoconductive pigments dispersed in a resin binder mixture comprised of two polymers, and a charge transport layer wherein one polymer is a polyvinylcarbazole and the second polymer is a polycarbonate homopolymer.

2. A layered photoconductive imaging member comprised of a supporting substrate, a photogenerator layer comprised of benzimidazole perylene photoconductive pigments dispersed in a resin binder mixture of polyvinylcarbazole and polycarbonate homopolymer, and thereover a charge transport layer.

3. An imaging member in accordance with claim 2 wherein the resin binder mixture is comprised of from 5 to 95 percent of polyvinylcarbazole and from 95 to 5 percent of polycarbonate.

4. An imaging member in accordance with claim 2 wherein the binder mixture is comprised of polyvinylcarbazole and polyvinylbutyral.

5. An imaging member in accordance with claim 4 wherein the resin binder mixture is comprised of from 5 to 95 percent of polyvinylcarbazole and from 95 to 5 percent of polyvinylbutyral.

6. An imaging member in accordance with claim 2 wherein the binder mixture is comprised of polyvinylcarbazole and a polyester.

7. An imaging member in accordance with claim 6 wherein the resin binder mixture is comprised of from 5 to 95 percent of polyvinylcarbazole and from 95 to 5 percent of a polyester.

8. An imaging member in accordance with claim 2 wherein the weight ration of benzimidazole perylene to binder mixture varies from 30:70 to 90:10.

9. An imaging member in accordance with claim 1 wherein the charge transport layer is comprised of aryl diamines dispersed in a resin binder.

10. An imaging member in accordance with claim 2 wherein the charge transport layer is comprised of aryl diamines dispersed in a resin binder.

11. An imaging member in accordance with claim 1 wherein the pigments are N,N'-substituted-3,4,9,10-perylene-bis(dicarboximide) compounds where the substituted groups are alkyl, aryl, arylalkyl, halogenated alkyl, halogenated aryl, or halogenated arylalkyl.

12. A layered photoconductive imaging member consisting essentially of a photoconductive layer comprised of perylene photoconductive pigments dispersed in a resin binder mixture of polyvinylcarbazole and polycarbonate homopolymer.

13. An imaging member in accordance with claim 12 wherein the polycarbonate is poly(oxycarbonyloxy-1,4-phenyleneisopropylidene-1,4-phenylene) or poly(oxcarbonyloxy-1,4-phenylenecyclohexyldene-1,4-phenylene).

14. An imaging member in accordance with claim 12 wherein the resin binder mixture is comprised of from about 5 to about 95 percent of polyvinylcarbazole and from about 95 to about 5 percent of polycarbonate.

15. An imaging member in accordance with claim 12 wherein the binder mixture is comprised of polyvinylcarbazole, polyvinylbutyral and polycarbonate homopolymer wherein the weight percent of polyvinylcarbazole is from about 5 to about 30.

16. An imaging member in accordance with claim 3 wherein the molecular weight of the polyvinylcarbazole is from about 200,000 to about 1,000,000, and the molecular weight of the polycarbonate is from about 15,000 to about 500,000.

17. An imaging member in accordance with claim 4 wherein the molecular weight of the polyvinyl butyral is from about 200,000 to about 300,000.

18. An imaging member in accordance with claim 6 wherein the molecular weight of the polyester is from about 15,000 to about 80,000.

19. An imaging member in accordance with claim 11 wherein the binder mixture is comprised of polyvinylcarbazole and polycarbonate homopolymer.

20. A process for improving the electrical characteristics of imaging members which comprises adding to the photogenerator layer of such members a binder mixture of polyvinylcarbazole and a polycarbonate homopolymer.

21. A process in accordance with claim 20 wherein the polycarbonate is poly(oxycarbonyloxy-1,4-phenyleneisopropylidene-1,4-phenylene) or poly(oxcarbonyloxy-1,4-phenylenecyclohexyldene-1,4-phenylene), and the photosensitivity of the imaging member is increased.

22. A member in accordance with claim 1 wherein the polycarbonate is poly(oxycarbonyloxy-1,4-phenyleneisopropylidene-1,4-phenylene) or poly(oxcarbonyloxy-1,4-phenylenecyclohexyldene-1,4-phenylene).

23. A layered photoconductive imaging member comprised of a supporting substrate, a photogenerating layer comprised of perylene photoconductive pigment, and top charge transport layer wherein the improvement resides in selecting for the perylene photoconducting pigments, a resin binder mixture of a polyvinylcarbazole and a polycarbonate homopolymer.

24. An imaging member in accordance with claim 23 wherein the polycarbonate is poly(oxycarbonyloxy-1,4-phenyleneisopropylidene-1,4-phenylene) or poly(oxcarbonyloxy-1,4-phenylenecyclohexyldene-1,4-phenylene).

* * * * *